United States Patent [19]

Lautenschläger et al.

[11] Patent Number: 5,022,117

[45] Date of Patent: Jun. 11, 1991

[54] CABINET HINGE WITH CLOSING MECHANISM

[75] Inventors: Karl Lautenschläger, Reinheim; Gerhard W. Lautenschläger, Brensbach, both of Fed. Rep. of Germany

[73] Assignee: Karl Lautenschläger GmbH & Co. KG, Reinheim, Fed. Rep. of Germany

[21] Appl. No.: 508,773

[22] Filed: Apr. 12, 1990

[30] Foreign Application Priority Data

Apr. 15, 1989 [DE] Fed. Rep. of Germany ..... 39124940

[51] Int. Cl.[5] ..... E05D 11/10

[52] U.S. Cl. ..... 16/288; 16/294; 16/296

[58] Field of Search ..... 16/288, 294, 296, 302

[56] References Cited

U.S. PATENT DOCUMENTS 3,744,086 7/1973 Salice et al. ..... 16/302
4,226,001 10/1980 Salice ..... 16/294

FOREIGN PATENT DOCUMENTS 2459008 6/1976 Fed. Rep. of Germany ..... 16/302

*Primary Examiner*—Lowell A. Larson
*Assistant Examiner*—Carmine Cuda

[57] ABSTRACT

Cabinet hinge whose door-related part in the form of a cup set in a mortise is articulated to the carcase-related part configured as an elongated supporting arm of inverted U-shaped cross section by two hinge links whose ends are journaled in the cup at one end and on the supporting arm at the other. A closing mechanism is provided in the door-end of the supporting arm and has a cam surface configured nonrotationally on the inner hinge link. A resiliently deformable section of one leg of a substantially U-shaped leaf spring engages the cam surface with bias, and the end remote from the cup of the other leg is fastened inside of the supporting arm by a section of the web of the latter. The inner hinge link has at the end by which it is mounted in the supporting arm two parallel ears formed by tabs cut and bent at right angles from the lateral margins of its end inside of the supporting arm. The cam surface is formed in the area of the bottom of the inner hinge link that is between the ears, and the resiliently springing leg of the leaf spring in contact with the cam surface is under a bias seeking to bring its free resilient end toward the second leg held in the supporting arm.

6 Claims, 1 Drawing Sheet

CABINET HINGE WITH CLOSING MECHANISM

BACKGROUND OF THE INVENTION

The invention relates to a hinge for cabinet doors, with a door-related hinge part in the form of a cup which can be set in a recess in the back of a door, and a carcase-related part in the form of an elongated supporting arm of inverted U shaped cross section, which are articulated together by two hinge links journaled at their extremities in the cup at their one end and on the supporting arm at their other end, and having a closing mechanism which is provided in the supporting-arm end of the inner hinge link that is nearer the cabinet interior when the door is closed, and which has a cam surface which is formed corotationally on the inner hinge link and on which a resiliently deformable section of one leg of a substantially U shaped leaf spring lies with bias, whose other leg is joined by a bridging section to the end of the resiliently deformable leg remote from the cup and is held in the interior of the supporting arm.

Such hinges have proven their worth in practice (DE-PS 24 08 057) and have been used for many years in considerable numbers for hanging doors on the carcases of cabinets. The cam surface in these hinges is formed on a cam element which is formed by two plastic cam disks fitted onto the opposite lateral edges of the supporting wall end of the inner hinge link that is provided with a rolled pivot eye, and which are fastened on the hinge link. The resiliently deformable leg of the leaf spring cooperating with the cam surface of the cam element must on the one hand engage the cam with a certain bias, and on the other hand it must be additionally resiliently deformable to a sufficient extent to produce the desired closing characteristic. Therefore the leg and thus the leaf spring as a whole must have a certain length. This, however, requires that sufficient space be available in the interior of the supporting arm for the mounting of the leaf spring. Since the resiliently deformable leg of the leaf spring presses on the cam surface running along the cam body above the pivot eye, the spring is used to produce the necessary spring bias such that the deformable limb seeks to move away from the second leg of the leaf spring held in the supporting arm. The known closing mechanism is not directly applicable in those hinges in which the space above the front end of the supporting arm is narrowed, because for example the adjusting screw serving to vary the amount of overlap of the door on the front edge of the side wall of the cabinet carcase is offset relatively close in the front end area of the supporting arm so as to keep the supporting arm especially short. The case is especially critical if such a supporting arm is greatly offset, i.e., its front end adjacent the cup is at a relatively great distance from the inside surface of the corresponding carcase wall, since the said adjusting screw then has to be disposed in a trough like indentation in the web of the supporting arm. The wall terminating this trough-like indentation then additionally reduces the space available for the spring to such an extent that the known closing mechanism can no longer be contained in the supporting arm or can be contained in it only with great difficulty.

It is accordingly the object of the invention so to improve the known hinge that even in a case in which the space available for accommodating the leaf spring within the supporting arm is limited, it can be provided with a functionally corresponding closing mechanism which will be comparable as regards manner of operation and reliability.

SUMMARY OF THE INVENTION

Setting out from a hinge of the kind described above, this object is achieved by the invention by the fact that the inner hinge link has on its end journaled in the supporting arm two parallel ears formed by bending at right angles the margins of its end portion within the supporting arm, that the cam surface is formed in the area of the underside of the inner hinge link that is situated between the ears, and that the resiliently springing leg of the leaf spring lying against the cam surface is under a bias seeking to bring its free, flexing end toward the second leg held in the supporting arm. The resiliently deformable leg of the leaf spring therefore reaches under the rearward end portion of the inner hinge link between the ears and presses against the cam surface formed on the underside of the hinge link to the effect that the flexing leg seeks to approach the other leaf spring leg held in the supporting arm. Since the flexing leg of the leaf spring, therefore, overlaps the inner hinge link to a greater extent than is the case in the known hinges with closing mechanism, the web or transitional area of the leaf spring connecting the two legs can be disposed further toward the front, cabinet-exterior end of the supporting arm and the need for space for the springs within the supporting arm is reduced.

The cam surface itself can be formed by the permanent deformation of the inner hinge link in its portion joining together the ears, in which case the area of the resiliently deformable leg of the leaf spring that cooperates with the cam surface is covered with a friction reducing plastic material.

Alternatively, the cam surface can also be formed on a cam element of friction reducing plastic provided on the underside of the end portion of the inner hinge link that joins the ears together, in which case the corresponding leg of the leaf spring bears directly on the cam surfaces.

To hold the U shaped leaf spring in the supporting arm in the transitional area joining its two legs it may be desirable for the configuration to be such that this transitional area wraps around a pin fixed in the sides of the supporting arm, the pin being provided with a bushing of plastic whose outside diameter corresponds substantially to the inside diameter of the transitional area of the U shaped leaf spring.

Then it will be possible to combine into an integral plastic part the covering of the resilient leg of the leaf spring, which cooperates with the cam of the inner hinge link, and the bushing-like bearing on the pin around which the transitional section of the leaf spring is wrapped.

BRIEF DESCRIPTION OF THE DRAWING

The invention is explained in greater detail in the following description of two embodiments, in conjunction with the drawing, wherein.

DESCRIPTION OF PREFERRED EMBODIMENTS

Figure 1:
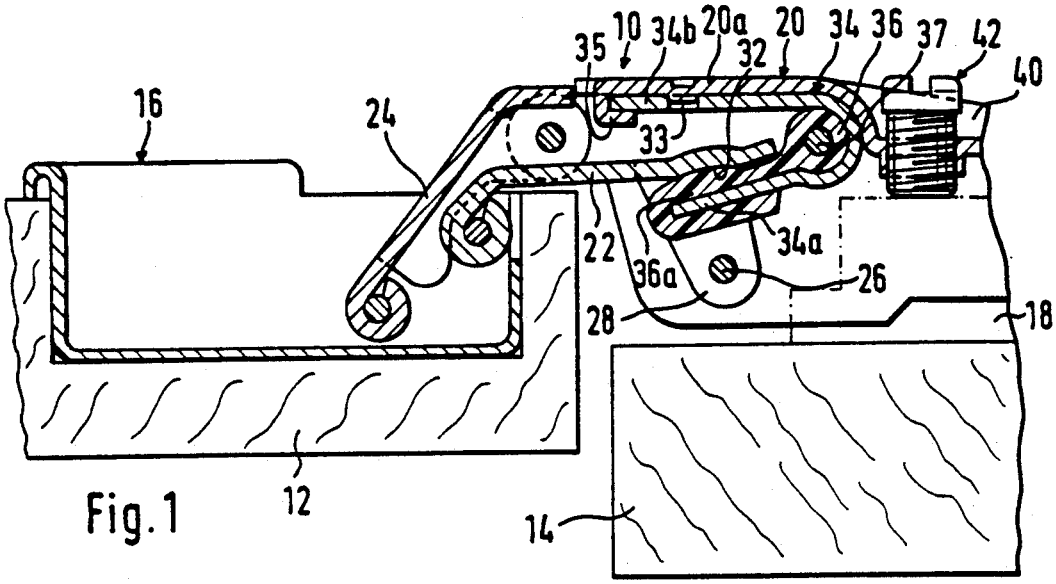
FIGS. 1 and 2 are longitudinal central sections through the cup end of the supporting arm and through the cup of a hinge in accordance with the invention, as well as the corresponding portion of the carcase wall and of the door of a cabinet, in the open and closed positions, respectively, of the hinges.
Figure 2:
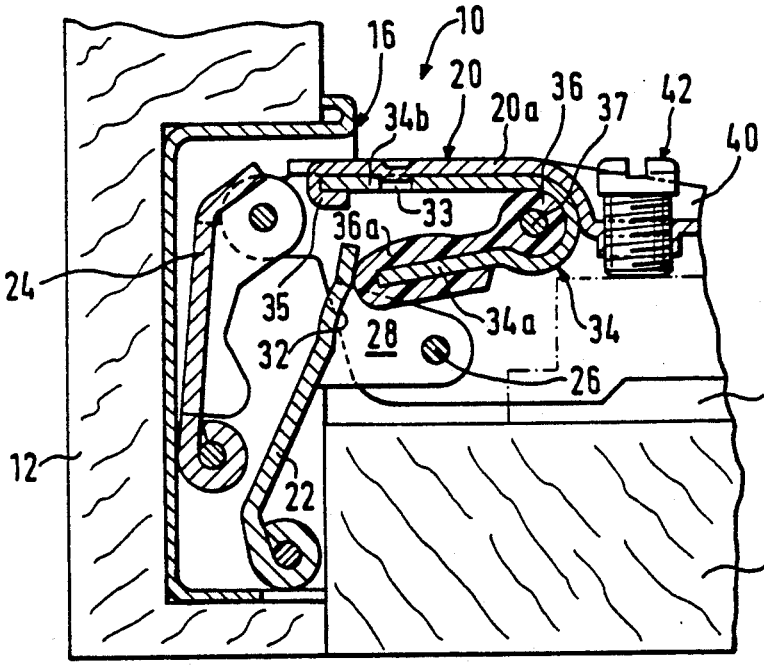

The hinge shown in FIGS. 1 and 2 and identified as a whole by the numeral 10 serves for the hanging of a door 12 on the wall 14 of a cabinet carcase that otherwise is not represented. The hinge 10 consists in a known manner of a door related hinge part in the form of a cup 16 which can be sunk in a mortise in the back of the door 12, and which is coupled to the carcase-related hinge part adjustably held on a mounting plate 18 fastened to the wall 14 and configured as an elongated supporting arm 20 of U-shaped cross section by means of two links 22 and 24 journaled at their extremities in the cup 16 and on the supporting arm 20.

The inner link 22 nearer the cabinet interior when the door 12 is closed has on its supporting arm end two elongated, parallel ears 28 bent from the lateral margins of the actual link 22, and having in their free end area bores through which a pivot pin 26 passes, which is fixed in the supporting arm. The inner hinge link 22 is therefore journaled on the pivot pin 26 at the supporting arm. In the end portion of link 22 between the ears 28, i.e., the portion that joins together the ears 28, a concavely curved cam surface 32 is stamped at the underside of the link end facing the pivot pin 26, which can be assumed to extend over the entire width between the ears 28.

With the cam surface 32 cooperates a resiliently deformable leg 34*a* of the U-shaped leaf spring 34 whose second leg 34*b* is held in contact with the underside of the web of the supporting arm 20. The leaf spring 34 is held on the one hand by a pin 32 set in the flanges of the supporting arm 20 and provided with a covering 36 of plastic for adaptation to the arcuate transition between the legs 34*a* and 34*b* and on the other hand by an end section 35 of the web 20*a* of the supporting arm 20 which is bent around the free end of leg 34*b* pointing out from the interior of the supporting arm. An additional securing of the spring is furthermore obtained by the fact that the leg 34*b* has at a slight distance from its free front end a bore 33 in which a projection stamped from the web of the supporting arm 20 catches when the leaf spring 34 is in the proper position for installation.

The leg 34*a* of leaf spring 34 which is guided between the ears 28 and which can flex resiliently under the hinge link 22 is not in contact with the cam surface 32 directly, but through a covering 36*a* of friction-reducing plastic which is provided between them and shaped in the area of cooperation with the cam surface 32 to form a matching cam surface, and which in the illustrated embodiment is combined with the bearing 36 on the mounting pin 37 to form an integral component manufactured by infection molding from plastic, the covering 36*a* and the bearing 36 being joined together by a relatively thin section which accordingly can deform together with the leg 34*a*. Since the resilient leg 34*a* presses through the covering 36*a* from below against the cam surface 32, it is clear that the bias of the leg 34*a* is directed against the leg 34*b*, i.e., with respect to the released state when the leaf spring 34 is removed, the leg 34*a* and 34*b* of the leaf spring 34 are drawn apart when the spring is mounted in the supporting arm as represented in the drawing.

In FIGS. 1 and 2 is can also be seen that in a trough-like recess 40 in its web 20*a* the supporting arm 20 in the embodiment represented is provided with an adjusting screw 42 permitting the overlap of the (closed) door 12 on the front edge of the supporting wall 14 to be varied. Since this adjusting screw 42 is situated relatively far forward, i.e., toward the outer end of the supporting arm 20, in comparison to other known hinges, there is little space available for mounting the leaf spring 34 inside of the supporting arm in front of the wall terminating the trough-like recess 40 at the cup end and holding the leaf spring 34 additionally on the bearing 36. However, disposing the leaf spring 34 as described, such that the leg 34*a* provided with the covering 36*a* engages the bottom of the hinge link 22 between the ears 28, makes it possible to dispose the leaf spring 34 in the space saving manner described, in which the leg 34*a* has sufficient length to provide the necessary resilience.

Figure 3:
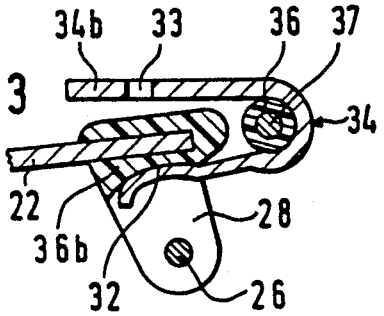
FIGS. 3 and 4 are longitudinal central sections through the leaf spring and the end of the inner hinge link that is situated inside of the supporting arm of a modified closing mechanism, in the open and closed positions, respectively.
Figure 4:
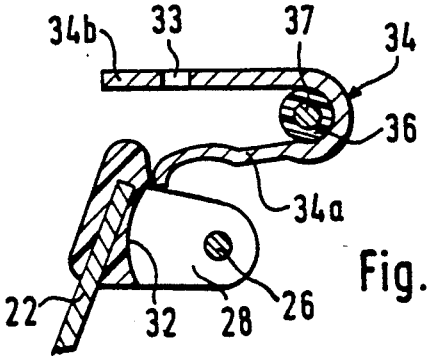

In FIGS. 3 and 4 there is shown a variant of the closing mechanism described above in conjunction with the embodiment according to FIGS. 1 and 2, and it consists essentially in the fact that the cam surface 32 formed on the inner hinge link 22 is not formed in the metal link 22 itself, but on a cam element 36*b* of friction reducing plastic which surrounds the hinge link 22 in its rearward area between the ears 28. Accordingly, the covering 36*a* of the leaf spring leg 34*a* of the embodiment according to FIGS. 1 and 2 can be omitted, i.e., leg 34*a* will slide directly on the cam surface 32. Since when the hinge turns the cam element 36*b* performs a movement relative to pin 37 and to the bearing 36 surrounding this pin 37 and holding the leaf spring 34 at the transition between the legs 34*a* and 34*b*, the bearing 36 in this case is a separate, sleeve like component of plastic.

We claim:

1. A hinge for a cabinet door comprising: a door-related hinge part in the form of a cup to be set in a recess in the door, and a carcase-related hinge part in the form of an elongated supporting arm of inverted U-shaped cross section, an inner and an outer hinge link pivotally connecting said hinge parts to each other, each hinge link having a first end journalled in the cup and a second end journalled on the supporting arm, a closing mechanism provided at the second end of the inner hinge link which is nearer the interior of the cabinet when the door is closed, said closing mechanism including a cam surface corotationally formed on said inner hinge link, a substantially U-shaped leaf spring having a first, resiliently deformable leg lying with bias on said cam surface, said leaf spring also having a second leg held within the U-shaped cross section of said supporting arm, and a bridging section joining said two legs, said second end of said inner hinge link having two parallel ears formed by bending at right angles margins of said inner hinge link, said cam surface being located between said ears, the bias of said leaf spring biasing said first leg being toward said second leg.

2. A hinge according to claim 2, wherein said cam surface is formed by permanent deformation of said inner hinge link between said ears, said first leg of the leaf spring cooperating with said cam surface having a covering of a friction-reducing plastic material.

3. A hinge according to claim 1, wherein said cam surface is formed on a cam element of friction-reducing plastic provided on a bottom of said second leg of said inner hinge link joining together the ears.

4. A hinge according to claim 2, wherein said bridging section of said U-shaped leaf spring is wrapped around a pin fixed in sides of said supporting arm, a sleeve-like bearing of plastic provided on said pin, said bearing having an outside diameter corresponding substantially to the inside diameter of the bridging section of the U-shaped leaf spring.

5. A hinge according to claim 3, wherein said bridging section of said U-shaped leaf spring is wrapped around a pin fixed in sides of said supporting arm, a sleeve-like bearing of plastic provided on said pin, said bearing having an outside diameter corresponding substantially to the inside diameter of the bridging section of the U-shaped leaf spring.

6. A hinge according to claim 4, wherein said covering of said first leg of said leaf spring and said sleeve-like bearing of said pin are formed of an integral plastic component.

* * * * *